United States Patent [19]

Collins

[11] 4,117,948

[45] Oct. 3, 1978

[54] INSULATED SERVER WITH COOPERATING PANS

[75] Inventor: Harry F. Collins, Golden Valley, Minn.

[73] Assignee: Service Ideas, Inc., Minneapolis, Minn.

[21] Appl. No.: 833,520

[22] Filed: Sep. 15, 1977

Related U.S. Application Data

[63] Continuation of Ser. No. 733,186, Oct. 18, 1976, abandoned.

[51] Int. Cl.[2] ..... B65D 25/00; A47J 41/00; B65D 21/02

[52] U.S. Cl. ..... 220/410; 220/20; 220/3.1; 220/23.83

[58] Field of Search ..... 220/3.1, 17, 20, 21, 220/23.6, 23.8, 63 R, 23.83, 23.86; D7/23, 37

[56] References Cited

U.S. PATENT DOCUMENTS

| | | | |
|---|---|---|---|
| 2,497,976 | 2/1950 | Burley | 220/20 |
| 2,545,528 | 3/1951 | Murray | 220/17 X |
| 3,078,005 | 2/1963 | Lewerth | 220/20 |
| 3,164,285 | 1/1965 | Melich | 220/17 |
| 3,240,610 | 3/1966 | Cease | 220/23.6 X |
| 3,532,247 | 10/1970 | Bridges | 220/23.6 |

*Primary Examiner*—William Price
*Assistant Examiner*—Steven M. Pollard
*Attorney, Agent, or Firm*—Williamson, Bains, Moore & Hansen

[57] ABSTRACT

The combination cooking, serving and eating unit disclosed herein employs a heat-resistive deck-like invertible body which has multi-functional rather deep protruding endless flanges on both sides thereof. These two flanges are of different area dimensions for respectively receiving and insulating, selectively usable cooking pans containing piping hot foods. The outer peripheral edges of the two flanges are smooth and preferably continuous to seal with upper portions of the cooking pans in use. The two pans constituting parts of the invention, made of metal or other heat-transmissive material in configuration and depth are made to conform in shapes to the two different pockets formed by the two said flanges with the deck portion of the body with the aforesaid spaced insulating relation. The end portions of the invertible heat resistive body are extended somewhat to provide handle portions to facilitate handling and serving of the assembled device with the piping hot dish therein. In use the server body is supported on the smooth edges of one of the said flanges and the cooking pans for the opposite flange extends upwardly and will receive the appropriate selected pan which has had the prepared food cooked thereon. Likewise when the other size pan is desired for cooking and containing food, the deck-like body is inverted and the other flange receives the other sized pan.

2 Claims, 4 Drawing Figures

INSULATED SERVER WITH COOPERATING PANS

This is a continuation of application Ser. No. 733,186 filed Oct. 18, 1976, now abandoned.

BACKGROUND OF THE INVENTION

For the past 20 years the eating of piping hot or very warm food dishes both in restaurants and at home has become more and more popular. Such dishes include pizza, most of the Italian dishes, Chinese dishes, sizzling steaks and chops, and numerous of the specially prepared potatoes. Most of these dishes or hot foods are spooned out of the original pots or pans in which they are cooked and are served in china or pottery dishes or plates sometimes requiring additional serving dishes of larger diameter, and in some instances serving trays for handling by the housewife or the waitress for holding the piping hot dishes during the eating process. A few of such hot foods, such as pizza and specially prepared potatoes, are usually served in the pans or casserole cooking utensils in which they are cooked or superheated. In such cases the cooking pans with the food therein must be placed upon rather larger plates or dishes to facilitate handling and service and positioning of the hot dishes on a table for eating. In some few instances special trays of heat-insulating material have been provided to loosely accommodate the original cooking pan with the food therein.

In all the instances referred to, great dissipation of heat of the prepared food occurs during the serving and eating of the same, so that the hopeful and desired high temperature of the food is rapidly lost from the time it is placed on the table for eating.

While two or three of the prior art devices have shown a special insulated tray for nesting a specially designed single cooling pan, there has been no suggestion to my knowledge in the prior art of the combination of an invertible multi-functional holder-server combined with at least a pair of differently dimensioned alternatively useable metal cooking pans each of which may be received and sufficiently insulated during service and eating of the piping hot dish.

SYNOPSIS OF THE INVENTION

In its broad aspects the invention comprises the provision of a multi-functional, invertible, holder-server body constructed of heat-resistive and insulation material and its cooperating use with two or more alternatively useable metal cooking pans. The holder-server is in the form of a deck-like, generally horizontal body having on both sides thereof an outstanding flange of some substantial depth. The two flanges may be of various predetermined closed geometrical configurations and they are of different dimensions in area and have smooth, unbroken peripheral edges which provide multi-functional use.

In combination with this heat-resistive body, a pair or more of heat-transmissive cooking pans are provided, each being complemental in shape to one of said flanges and readily and compactly nestible therein. The said outstanding flange not in use for receiving a cooking pan constitutes a support for the assembled device and in use for eating engages a table forming a dead air space below the deck body to provide insulation for the deck and the cooking pan with hot food contained in the other flange which is then upstanding in use.

The cooperating metallic cooking pans are provided with outstanding flanges or downwardly tapered sidewalls so that when used with the hot dish contained therein they engage the peripheries of the flanges or portions close to the peripheries to suspend the pans for the most part in spaced symmetrical relation to the pocket formed by the flange, thereby providing dead air space for insulation of the greater part of the cooking pan. The deck body is extended at its ends some distances beyond the outstanding flanges to provide oppositely disposed handle portions by which the combination may be served by a waitress or the housewife, and of course such handle portions are spaced above the table through the media of the multi-functional flange then disposed bottomwise. The two flanges are preferably substantially coaxial with reference to the deck body.

The combination device, while particularly adapted for the cooking, serving and eating of pizza, is well adapted for the cooking, heating, serving and eating of a wide variety of prepared cooked foods.

DETAILED DESCRIPTION OF AN EMBODIMENT

The detailed construction, novel functions and advantages of this invention will be more fully apparent from the following description or specification made in conjunction with the accompanying drawings, wherein like reference characters refer to similar parts throughout the several views, and in which.

Figure 1:
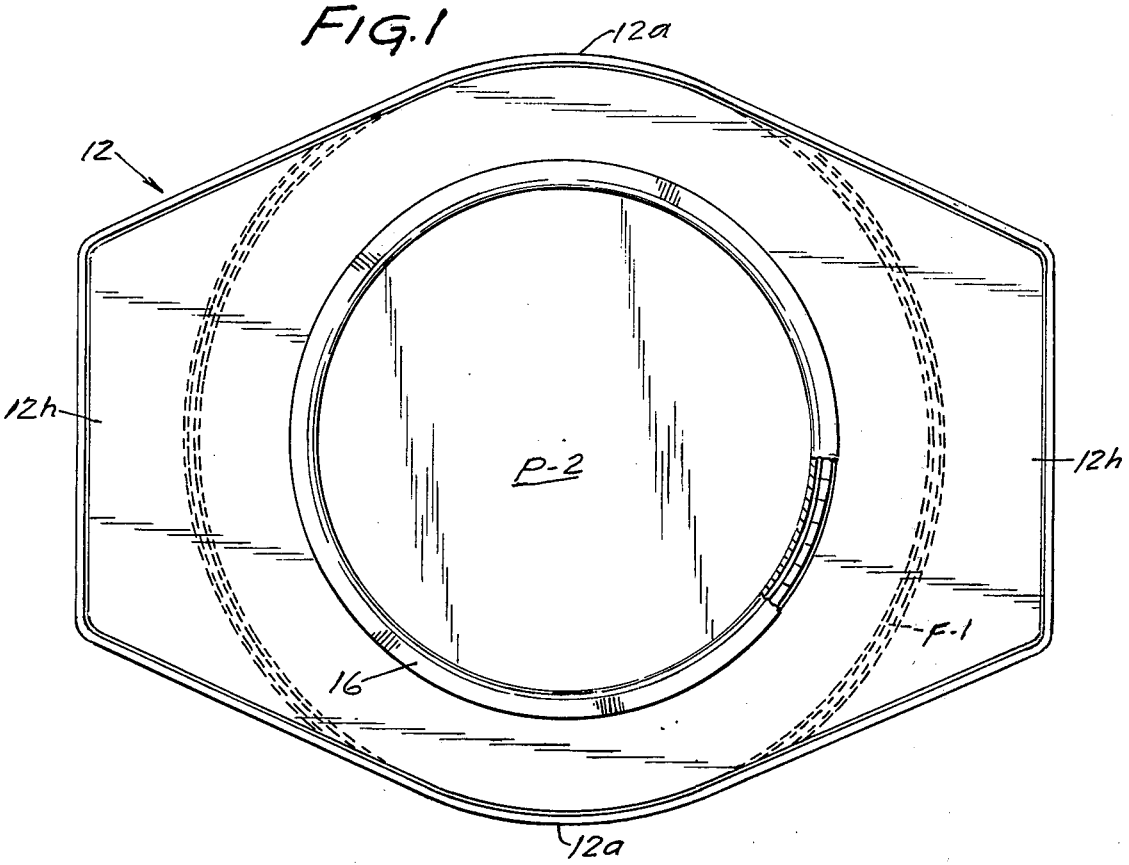
FIG. 1 is a top plan view of the device in assembled position for use with a smaller cooking pan employed in the pocket provided by the smaller upstanding flange F-2.
Figure 2:
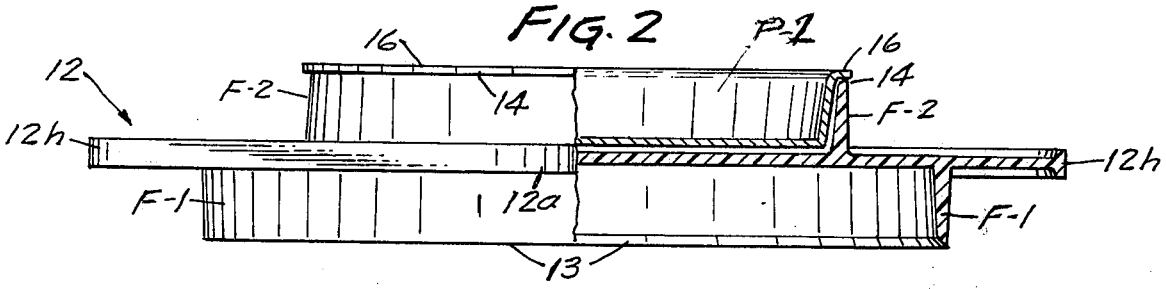
FIG. 2 is a longitudinal view half in side elevation and half in vertical section of the assembled unit as shown in FIG. 1.
Figure 3:
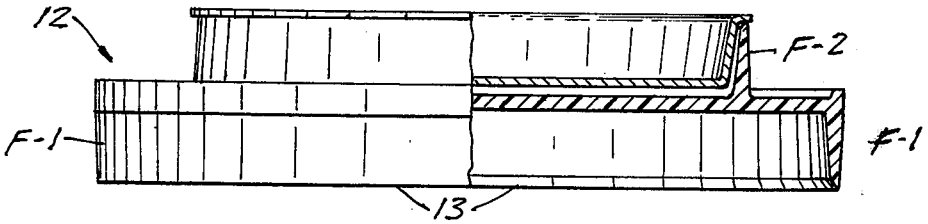
FIG. 3 is an end view half in end elevation and half in vertical section of the said combination.

Referring to the drawings, a heat-resistive body identified as an entirety by 12 is provided generally horizontal deck formation and constructed of heat-resistive material having insulation qualities such as certain of the plastics including phenolics or other moldable material having the essential heat-resistive and insulation qualities. Extending outwardly from the central portion of the deck body and preferably coaxially related are a pair of relatively deep flanges F-1 and F-2 respectively, preferably constructed integrally in the molding of the body. These flanges preferably have smooth, unbroken peripheral edges 13 and 14 respectively which lie in parallel horizontal planes when the combination device is supported upon a table for eating a hot cooked dish. The deck body is extended at opposite ends beyond some distance the larger flange F-1 to provide lifting and serving handles 12-h, which when the device is assembled extend in spaced relation above the supporting surface such as a table top or stove. Metallic or other heat-transmissive cooking pans p-1 and p-2 of appropriate peripheral configuration and dimensions constitute a part of my inventive combination, and as shown in FIGS. 1–3 inclusive the smaller cooking pan p-2 is employed in the complementary shaped flange F-2 while the body is supported upon the larger and then lower flange F-1. The cooking pan p-2 has a narrow outstanding flange or bead 16 which is seated upon and substantially seals with the peripheral edge 14 of the flange F-2, leaving because of the formation of the pan p-2 in shape of the pocket provided by the large supporting flange F-2, a dead air space surrounding the sidewalls and bottom of the pan. This is proven to be quite effective in insulation effect and lessening dissipation of heat from the piping hot food served in the pan p-2. With piping hot dishes such as pizza the cooked food in the pan p-2 is quickly lifted by the use of a suitable instrumentality for gripping the upper flange of the pan and then has the relationship illustrated in FIGS. 2 and 3 of the drawings.

The handle portions 12-h of the body enable the assembled device and the cooked food therein to be readily transported and served without any danger of burning the hands of the waitress or housewife. With the device as shown in FIGS. 2 and 3 assembled with a piping hot dish therein, it is supported upon a restaurant or dining table and the dead air space defined by the flange F-1 further insulates the body, the metal pan p-2 and most of the contents of the food and prevents damage to the table top or other surface on which the device is supported.

Figure 4:
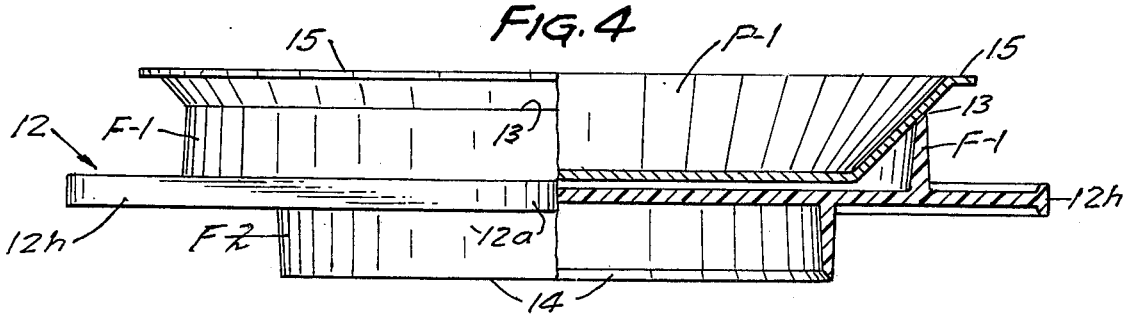
FIG. 4 is a side view half in side elevation and half in vertical section showing the alternative use of the deck body (inverted) with the employment of the larger cooking pan P-1.

In FIG. 4 the alternative use of the combination of the body with a larger cooking pan p-1 is shown. Here the body is inverted from the position of FIGS. 1–3 and will be supported on the smooth edge 14 of the smaller body flange F-2. Here the cooking pan p-1 differs in its generally circular configuration from top to bottom and actually the peripheral wall portion is engaged and seated on the smooth edge 13 of the larger flange F-1. It will of course be realized that the larger cooking pan p-1 may be made at its upper edge like the pan p-2 so that a flange is provided for seating at the upper edge of the cooking pan.

While the inventive combination is particularly adapted for the cooking, serving and eating of piping hot dishes such as pizza, it will be apparent that many hot dishes could be equally well cooked, served and eaten therefrom.

While in the embodiment illustrated, outstanding flanges F-1 and F-2 are shown of generally circular configuration as well as the general configuration of the cooking pans, various configurations of closed curvilinear or closed multi-angular construction can be equally well employed with all the functional advantages of the embodiment herein disclosed.

From the foregoing description it will be seen that a combination cooking, serving and eating unit has been provided, adapted in alternate use to insulate and hold cooking pans of prepared food which vary in overall dimensions. It will further be seen that the construction of the receiving flanges and pockets of the insulated server provide multi-functional results in supporting the assembled unit, in insulating the cooking pan and hot food contained therein and in providing handle means for facilitating handling and service of the assembled unit.

What is claimed is:

1. A cooking and serving assembly for alternatively cooking and serving two different quantities of food materials and for sustaining heat in the food materials while the same are being served and eaten, having in combination:

a tray body constructed of heat-insulation material in the form of an invertible, generally horizontal deck having a generally annular insulating and receiving flange protruding from one main surface of said deck and having a second, generally annular insulating flange protruding from the opposite surface of said deck, said second flange being of substantially larger area-dimension than said first flange and both of said flanges having their outward edges lying in planes disposed parallel with the common medial plane of said deck, a pair of heat-transmissive metal cooking pans, each being complemental in shape to one of said flanges and of somewhat smaller external peripheral dimension than the related insulating flange for respectively nesting and supporting the respective pan in its associated flange, and in use the flange which is not employed for nesting its related pan extending downward for support and insulation of said deck body from a horizontal surface.

2. The structure and combination set forth in claim 1, wherein;

each of said metal cooking pans is contoured and constructed to interfit within the related protruding flange of said tray body with symmetrical, slight spaced clearance between the peripheral wall of said flange and the peripheral wall of said pan, and having outwardly protruding means at the upper edge of the pan for sealed engagement and support of the pan from the outermost edge portion of the related flange, and said pans being of slightly less height than the height of the related flange, whereby in the use of the pans for the serving and eating of the hot food, a circumferential dead air space is provided between the peripheries of the pan and the interior wall of the corresponding flange, and also between the bottom of the pan and the deck surface of the server, such dead air spaces enhancing the preservation of heat in the food served and eaten.

* * * * *